United States Patent [19]

Varnum

[11] 4,079,929

[45] Mar. 21, 1978

[54] OSCILLATABLE BASE SPRING MOUNT FOR TOY HORSE

[76] Inventor: Richard O. Varnum, P.O. Box 487, Fort Klamath, Oreg. 97626

[21] Appl. No.: 728,049

[22] Filed: Sep. 30, 1976

[51] Int. Cl.[2] ..... A63G 17/00

[52] U.S. Cl. ..... 272/53.2; 248/387; 272/DIG. 4; 297/196

[58] Field of Search ..... 272/52, 52.5, 53.1, 272/53.2, 55, 56, 50, 51, 110, 132, 134, 135, 136, 137, 138, DIG. 4, 65, 66; 248/387, 392, 403; 297/181, 294, 295, 196, 290, 287; 280/1.22

[56] References Cited

U.S. PATENT DOCUMENTS

| | | | |
|---|---|---|---|
| 31,571 | 2/1861 | Crandall | 272/52 |
| 257,390 | 5/1882 | Saunders | 248/387 |
| 1,261,396 | 4/1918 | Jackman | 248/387 |
| 1,755,619 | 4/1930 | Westerlund | 272/52 |
| 2,463,286 | 3/1949 | Handley | 248/387 |
| 2,477,504 | 7/1949 | Varnum | 272/53.2 |
| 2,898,107 | 8/1959 | Varnum | 272/53.2 |

FOREIGN PATENT DOCUMENTS

| | | | |
|---|---|---|---|
| 157,891 | 1/1933 | Switzerland | 297/294 |
| 8,806 of | 1888 | United Kingdom | 297/196 |

*Primary Examiner*—Richard C. Pinkham
*Assistant Examiner*—Arnold W. Kramer
*Attorney, Agent, or Firm*—Clarence A. O'Brien; Harvey B. Jacobson

[57] ABSTRACT

Structure is provided whereby the lower leg of a horizontally disposed generally U-shaped leaf spring of a "hobby-horse" is oscillatably supported from its supportive base as opposed to rigidly secured thereto, but with oscillation of the leaf spring of the base limited to a relatively short arc of angular displacement. In addition, the lower leg of the U-shaped leaf spring includes structure whereby the axis of oscillation of the leaf spring relative to the base may be adjusted longitudinally of the lower leg and the base is equipped with spring-type abutment structure for limiting angular displacement of the lower leg of the spring relative to the base in at least one direction.

11 Claims, 5 Drawing Figures

OSCILLATABLE BASE SPRING MOUNT FOR TOY HORSE

BACKGROUND OF THE INVENTION

The toy horse of the instant invention comprises an improvement over the similar apparatus disclosed in my prior U.S. Pat. No. 2,898,107.

The toy horse disclosed in my prior patent as well as other similar toy horses of the "hobby-horse" type have a tendency to "walk" over the supporting surface therefor when in use. By providing limited oscillation between the leaf spring of the toy horse and the supporting base thereof a far more smoother operation of the toy horse is afforded and the tendency of the toy horse to "walk" over its supporting surface is substantially eliminated.

The main object of this invention is to provide a toy horse of the "hobby-horse" type constructed in a manner which will afford a smoother operation when in use.

Another object of this invention, in accordance with the immediately preceding object, is to provide a toy riding horse which will have very little tendency, if any, to "walk" over the supporting surface therefor.

Still another object of this invention is to provide a toy riding horse including handgrip portions thereof which are supported for at least slight movement relative to the seal portion thereof in order to provide a riding action which more closely simulates riding a real pony or horse.

A final object of this invention to be specifically enumerated herein is to provide a toy riding horse in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
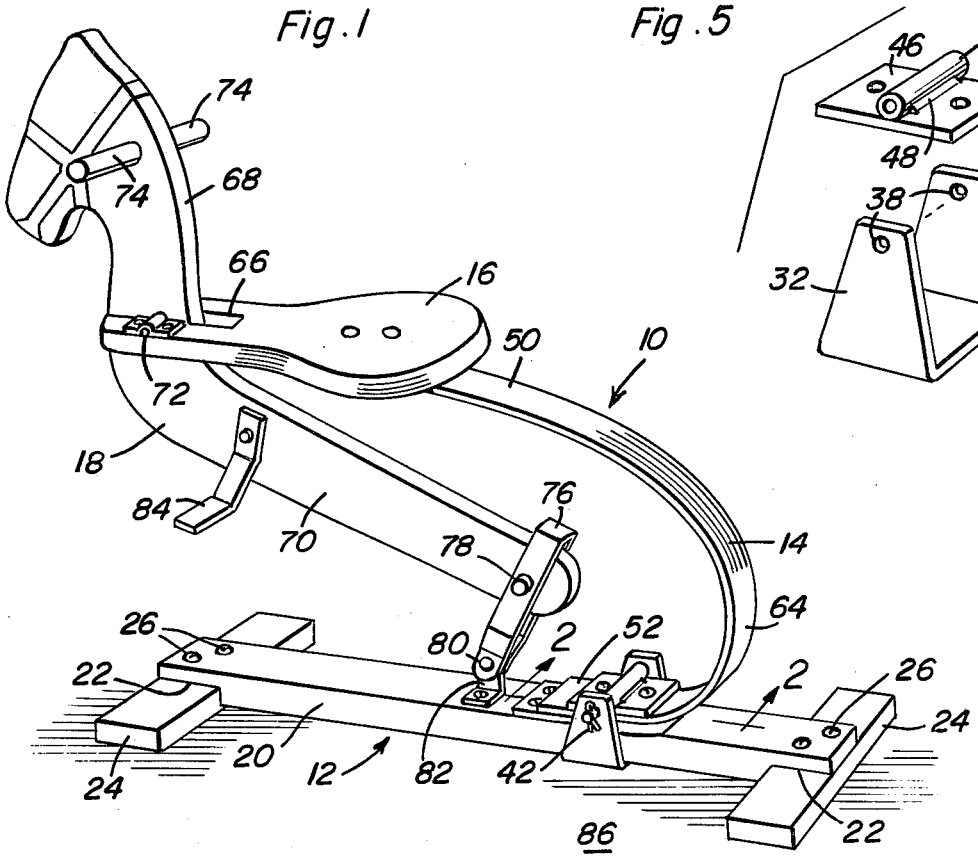
FIG. 1 is a perspective view of the toy riding horse of the instant invention.
Figure 5:
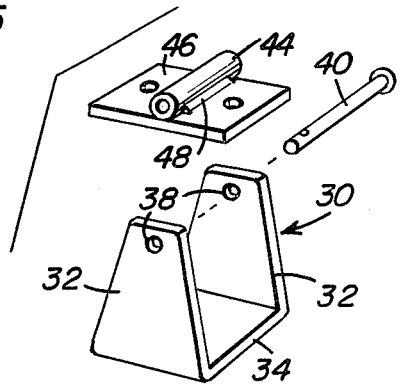
FIG. 5 is an exploded perspective view of the hardware which comprises the pivotal connection between the leaf spring of the horse and the base portion thereof.

Referring now more specifically to the drawings, the numeral 10 generally designates the toy horse of the instant invention. The horse 10 includes a base referred to in general by the reference numeral 12, a leaf spring 14, a seat 16 supported from the leaf spring 14 and an arm 18 extending between the base 12 and seat 16 and pivotally connected thereto at opposite end portions of the arm 18.

The base 12 includes an elongated member 20 including opposite ends having downwardly opening notches 22 formed therein and opposite end cross members 24 are secured in the notches 22 by means of suitable fasteners 26. The upper surface of the longitudinal member 20 has an upwardly opening concave recess 28 formed therein and a U-shaped mounting bracket referred to in general by the reference numeral 30 and including upstanding legs 32 interconnected at their lower ends by means of a bight portion 34 extending therebetween is secured to the longitudinal member 20 by means of fasteners 36 with the longitudinal member 20 received between the legs 32 and extending over the bight portion 34, the fasteners 36 being utilized to secure the bight portion 34 to the underside of the longitudinal member 20. The upper ends of the legs 32 are provided with aligned bores 38 through which a pivot pin 40 is removably secured by means of a cotter pin 42 and a sleeve 44 is journaled on the pin 40 between the legs 32 and has a mounting plate 46 secured to the underside thereof by welding 48.

The spring 14 includes upper and lower generally horizontal legs 50 and 52 and the plate 46 is secured to the lower leg 52 by means of fasteners 54 secured through the plate 46 and threaded into threaded bores formed in the leg 52. The leg 52 is provided with two sets of threaded bores 58 in which the screws 54 may be threadedly engaged. Accordingly, the pivot axis of the leg 52 relative to the mounting bracket 30 may be adjustably shifted longitudinally of the leg 52.

Figure 2:
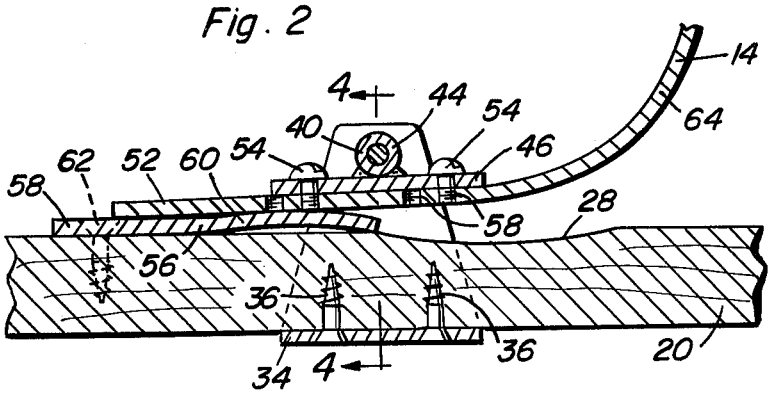
FIG. 2 is an enlarged fragmentary vertical sectional view taken substantially upon the plane indicated by the section line 2—2 of FIG. 1 and illustrating the pivotal connection between the U-shaped leaf spring of the horse and the base portion thereof.
Figure 4:
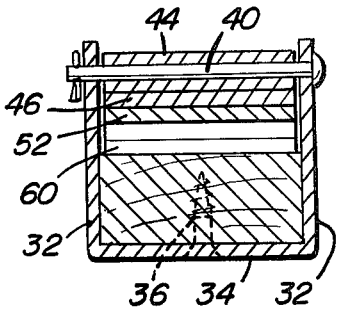
FIG. 4 is a vertical sectional view taken substantially upon the plane indicated by the section line 4—4 of FIG. 2.
Figure 3:
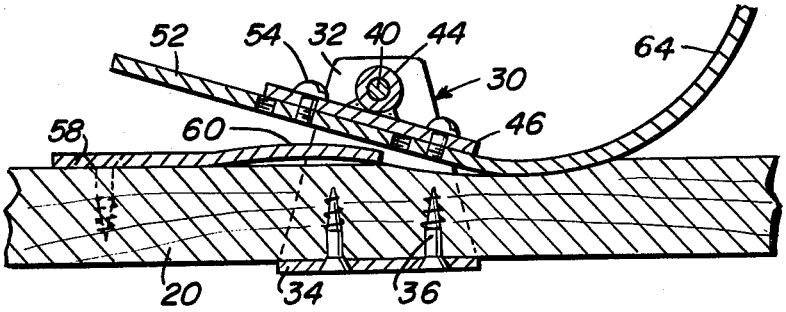
FIG. 3 is a fragmentary enlarged sectional view similar to FIG. 2 but with the leaf spring in an alternate position of oscillation relative to the base.

With attention now invited more specifically to FIGS. 2 and 3 of the drawings, it may be seen that a leaf spring 56 having a planar end portion 58 and an arched end portion 60 has its planar end portion 58 secured to the upper surface of the longitudinal member 20 by means of suitable fasteners 62 and with the arched end portion 60 disposed beneath the free end of the leg 52 of the spring 14. Accordingly, counterclockwise pivotal movement of the spring 14 relative to the longitudinal member 20 from the position thereof illustrated in FIG. 2 is limited by contact of the underside of the free end portion of the leg 52 with the arched end 60 of the spring 56. Also, it may be seen from FIG. 3 that oscillation of the spring 14 about the pivot pin 40 from the position thereof illustrated in FIG. 2 is limited by seated engagement of the lower end of the bight portion 64 of the spring 14 in the recess 28, the bight portion 64 extending between and interconnecting the legs 50 and 52 of the spring 14.

The forward end portion of the seat 16 is provided with a vertically extending and forwardly opening slot 66 upwardly through which the upper forward end 68 of an arm 70 extends and the arm 70 is pivotally anchored to the forward end of the seat 16 by means of pivot structure 72. The upper terminal end of the arm 70 is in the head of a horse and is provided with opposite side outwardly projecting handgrips 74. The lower end portion of the arm 70 has the upper end of a connecting link 76 pivotally connected thereto as at 78 and the lower end of the connecting link 76 is pivotally secured, as at 80, to a mounting bracket 82 supported from the upper surface of the longitudinal member 20 at a point spaced slightly forward of the spring 56. Finally, the mid-portion of the arm 70 between the connecting link 76 and the pivot connection 72 is provided with opposite side dependingly supported footrests 84.

In operation, forward and downward movement of the seat 16 from a rearward and upward limit position thereof defined by seated engagement of the lower end of the bight portion 64 of the spring 14 in the recess 28 will initially cause the spring 14 to assume its static condition and will thereafter cause the leg 52 to pivot from the position thereof illustrated in FIG. 3 to the position thereof illustrated in FIG. 2 with the leg 52 engaged with the arched end 60 of the spring 56. In addition, such movement of the seat 16 will cause the arm 70 to be slightly angularly displaced in a clockwise direction about the pivot connection 72 and will also cause the upper end of the link 76 to swing slightly forwardly. Of couse, when the seat 16 is moved upwardly and rearwardly from its forwardmost limit position the leg 52 of the spring 14 pivots from the position thereof illustrated in FIG. 2 back to the position thereof illustrated in FIG. 3.

The mounting bracket 30 is connected to the longitudinal member 20 in an extremely secure manner. Further, the greater downward force exerted on the seat 16 during use of the toy riding horse 10 is cushioned by engagement of the leg 52 of the spring 14 with the arched end 60 of the leaf spring 56. Thus, there is little tendency of the base 12 of the toy riding horse 10 to walk over the surface 86 upon which the base 12 rests.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A riding device comprising an elongated base, a horizontally disposed generally U-shaped leaf spring including upper and lower generally parallel legs interconnected at one pair of corresponding ends by means of an integral curved bight portion extending therebetween, means oscillatably supporting said lower leg from said base adjacent one end thereof for limited oscillation about a horizontal axis extending transversely of said lower leg and base and with said curved bight portion facing outwardly of said one end of said base, a seat supported from the free end portion of said upper leg remote from said bight portion, said means oscillatably supporting said lower leg from said base including an upwardly opening U-shaped bracket having upstanding opposite side legs and a bight portion extending between the lower ends of said legs, said base being cradled by and extending through said bracket, the upper ends of said legs projecting upwardly above said base, a pivot pin secured through the upper ends of said legs, a sleeve journaled on said pin, means securing said sleeve to the lower leg of said spring, attaching means securing said bight portion to the underside of said base, said means securing said sleeve to the lower leg of said spring including releasable adjustment means for adjustable shifting said lower leg with respect to said sleeve.

2. The combination of claim 1 including an elongated inclined arm having upper and lower ends adjacent said free end portion and said axis, respectively, means pivotally anchoring an upper portion of said arm to said free end portion for angular displacement relative thereto about a second axis generally paralleling the first mentioned axis, an upstanding connecting link including upper and lower ends, and means pivotally attaching the upper and lower ends of said link to said lower end of said arm and said base, respectively, about axes generally paralleling the first mentioned axis.

3. The combination of claim 2 wherein said arm includes footrest means supported therefrom intermediate said second axis and link and disposed at an elevation below said seat.

4. The combination of claim 3 wherein said arm includes an upper terminal end portion projecting upwardly above said seat and provided with handgrip means.

5. The combination of claim 1 wherein said base includes upwardly facing abutment means engageable by undersurface portions of said lower leg on opposite sides of said axis to define limits of oscillation of said lower leg.

6. The combination of claim 5 wherein said one of said abutment means comprises leaf spring means anchored relative to said base.

7. The combination of claim 6 including an elongated inclined arm having upper and lower ends adjacent said free end portion and said axis, respectively, means pivotally anchoring an upper portion of said arm to said free end portion for angular displacement relative thereto about a second axis generally paralleling the first mentioned axis, an upstanding connecting link including upper and lower ends, and means pivotally attaching the upper and lower ends of said link to said lower end of said arm and said base, respectively, about axes generally paralleling the first mentioned axis.

8. A riding device comprising an elongated base, a horizontally disposed generally U-shaped leaf spring includng upper and lower generally parallel legs interconnected at one pair of corresponding ends by means of an integral curved bight portion extending therebetween, means oscillatably supporting said lower leg from said base adjacent one end thereof for limited oscillation about a horizontal axis extending transversely of said lower leg and base and with said curved bight portion facing outwardly of said one end of said base, a seat supported from the free end portion of said upper leg remote from said bight portion, said means oscillatably supporting said lower leg from said base including a horizontal transverse pivot pin supported from said base adjacent said one end thereof with said pivot pin spaced above said base, a mount secured to said base including a sleeve through which said pin extends and in which said pin is rotatably received, means securing said mount to said lower leg with said sleeve disposed above and extending transversely of said lower leg and with the latter, when generally paralleling said base, spaced above the latter, said means securing said mount to said lower leg including releasable adjustment means for adjustably shifting said lower leg with respect to said mount, and therefore with respect to said sleeve.

9. The combination of claim 8 including an elongated inclined arm having upper and lower ends adjacent said free end portion and said axis, respectively, means pivotally anchoring an upper portion of said arm to said free end portion for angular displacement relative thereto about a second axis generally paralleling the first mentioned axis, an upstanding connecting link including upper and lower ends, and means pivotally attaching the upper and lower ends of said link to said lower end of said arm and said base, respectively, about axes generally paralleling the first mentioned axis.

10. The combination of claim 8 wherein said base includes upwardly facing abutment means engageable by undersurface portions of said lower leg on opposite side of said axis to define limits of oscillaton of said lower leg.

11. The combination of claim 10 wherein said one of said abutment means comprises leaf spring means anchored relative to said base.

* * * * *